US006188367B1

(12) United States Patent
Morrison et al.

(10) Patent No.: US 6,188,367 B1
(45) Date of Patent: Feb. 13, 2001

(54) DEVICE FOR POSITIONING AN ANTENNA

(75) Inventors: Stephen A. Morrison, Winter Springs, FL (US); Chris L. Hadley, Zionsville, IN (US)

(73) Assignee: TracStar Systems, Inc., Orlando, FL (US)

( * ) Notice: Under 35 U.S.C. 154(b), the term of this patent shall be extended for 0 days.

(21) Appl. No.: 09/273,944

(22) Filed: Mar. 22, 1999

(51) Int. Cl.[7] ..... H01Q 3/08
(52) U.S. Cl. ..... 343/765; 343/757
(58) Field of Search ..... 343/765, 882, 343/763, 766, 757

(56) References Cited

U.S. PATENT DOCUMENTS

| | | | | |
|---|---|---|---|---|
| 3,987,452 | * | 10/1976 | Godet | 343/765 |
| 4,392,140 | * | 7/1983 | Bastian et al. | 343/765 |
| 4,577,825 | * | 3/1986 | Pinson | 248/550 |
| 5,471,219 | | 11/1995 | Rodeffer et al. | 342/359 |
| 5,517,205 | | 5/1996 | van Heyningen et al. | 343/765 |
| 5,528,250 | | 6/1996 | Sherwood et al. | 343/711 |
| 5,554,998 | | 9/1996 | Sherwood et al. | 343/881 |
| 5,585,804 | | 12/1996 | Rodeffer | 342/359 |
| 5,646,638 | | 7/1997 | Winegard et al. | 343/882 |

* cited by examiner

*Primary Examiner*—Don Wong
*Assistant Examiner*—James Clinger
(74) *Attorney, Agent, or Firm*—Holland & Knight; David G. Maire; James H. Beusse

(57) ABSTRACT

A device for positioning an antenna on a vehicle. The device includes a first motor-driven timing belt connected to opposite sides of the antenna frame for rotating the antenna about its elevational axis. A constant force spring or a cam compensates for changes in belt path geometry as the antenna rotates. A second motor-driven timing belt is wrapped around a perimeter of a base plate for rotating the antenna about its azimuth axis. Electrical signals for the antenna and the drive motors are multiplexed and passed through a single coaxial cable in a rotary joint along the axis of azimuth rotation.

6 Claims, 2 Drawing Sheets

DEVICE FOR POSITIONING AN ANTENNA

FIELD OF THE INVENTION

This invention relates generally to the field of satellite antennas, and more specifically to the field of mechanisms for positioning an antenna, and in particular, to the field of mechanisms for positioning an antenna for use on a recreational vehicle.

BACKGROUND OF THE INVENTION

It is known to place an antenna on a vehicle such as a boat or recreational vehicle (RV) for receiving signals from a satellite, for example, a direct television signal. U.S. Pat. No. 5,517,205 issued to van Heyningen, et al, U.S. Pat. No. 5,528,250 issued to Sherwood, et al, and U.S. Pat. No. 5,585,804 issued to Rodeffer teach various apparatus and methods for mounting and positioning such antennas. Each of these patents is incorporated by reference herein.

Prior art devices for positioning antenna are typically driven by electric motors connected to the antenna by a gear mechanism. To reduce the size and cost of the drive motors, high ratio gear trains are often employed. However, such gearing systems create excessive slop in the drive train, thereby limiting the precision with which the antenna can be positioned. Furthermore, prior art devices are often limited in the amount of rotation that can be provided in the azimuth direction. For applications on boats and RV's an unlimited amount of rotation is desirable.

Accordingly, it is an object of this invention to provide a device for positioning an antenna that has small size, low cost, high accuracy of position, and an unlimited range of movement in the azimuth direction.

SUMMARY

In order to achieve these and other objects of the invention, a device for positioning an antenna is provided having: a frame for mounting the antenna, the frame having a first arm and a second arm connected about an axis of elevational rotation; a first timing belt having a first end connected to the first arm and a second end connected to the second arm; and a means for driving the first timing belt to rotate the frame about the axis of elevational rotation. The device may further have a means for maintaining tension in the first timing belt as the antenna is rotated. A device according to this invention may also have a bracket pivotally connected to the frame about the axis of elevational rotation and a base plate pivotally connected to the bracket for rotation of said bracket about an axis of azimuth rotation. A second timing belt may be wrapped in contact with at least a portion of a perimeter edge of the base plate; with a means for driving the second timing belt being connected to the bracket and operable to rotate the bracket about the axis of azimuth rotation. Electrical signals for the drive motors and the antenna may be multiplexed and passed through a single coaxial rotary joint.

DESCRIPTION OF THE PREFERRED EMBODIMENTS

Figure 1:
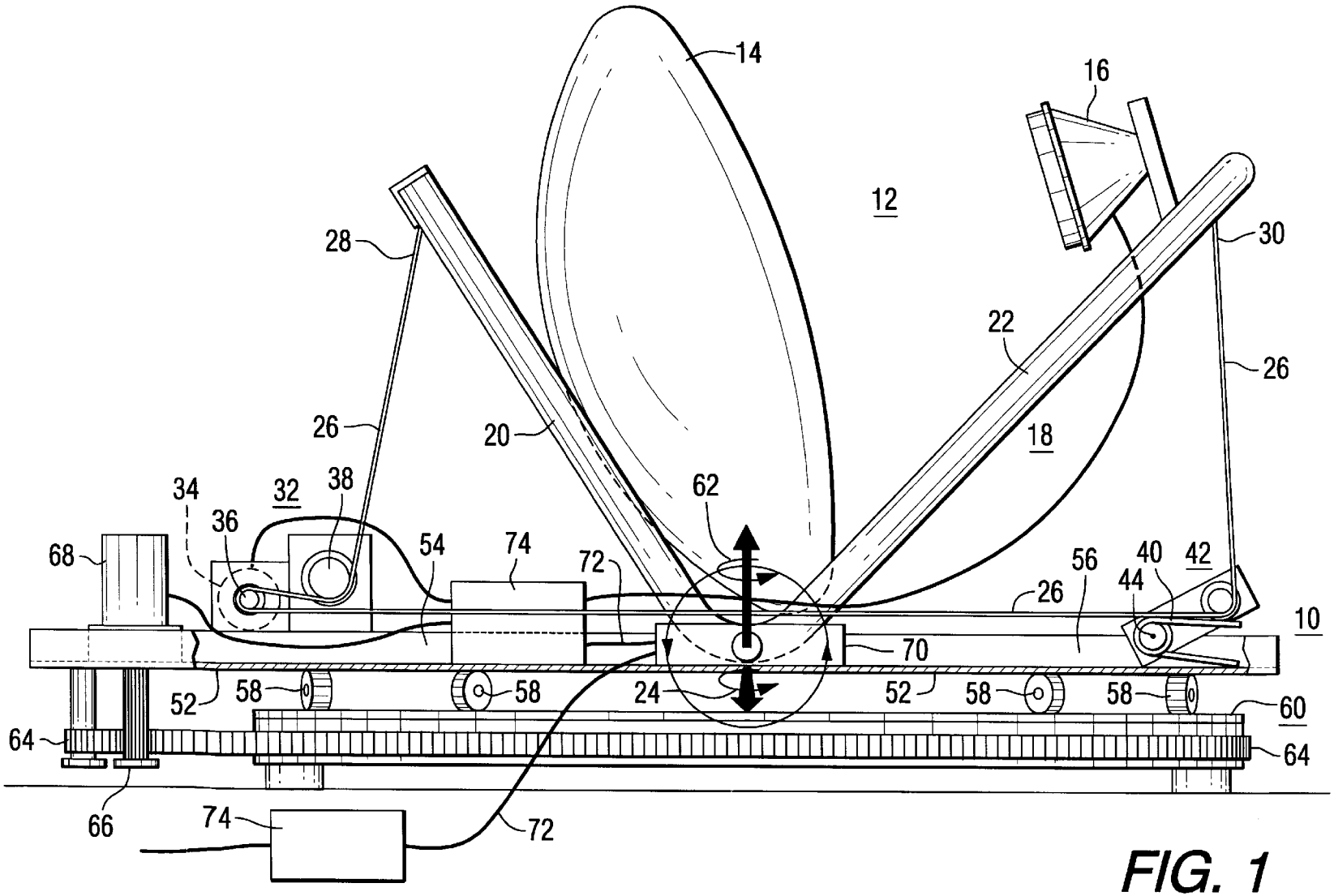
FIG. 1 is a perspective view of a device in accordance with this invention.

FIG. 1 illustrates a device 10 in accordance with this invention for positioning an antenna in both the azimuth (horizontal) and elevation (vertical) directions. The antenna 12 of FIG. 1 consists of a reflector 14 and a low noise block feed (LNBF) 16 associated therewith. In the embodiment of FIG. 1, both of these components are mounted on a frame 18 having a first arm 20 and a second arm 22 connected about an axis of elevational rotation 24. A belt such as timing belt 26 having a first end 28 and a second end 30 is connected to the first arm 20 and second arm 22 of the frame 18 respectively. The term belt as used herein is meant to include any sort of apparatus capable of exerting a mechanical force over a distance, and may include devices such as a timing belt, rope, wire, ribbon, etc. A belt is generally capable of exerting only a pulling force, although in some embodiments the term belt as used herein, may include a device capable of exerting a pulling and/or a pushing force. For example, a belt may include a flexible plastic rod inserting through a plastic tube wherein the tube is affixed to a structure so as to resist the bending of the rod under a pushing force. Other embodiments of this invention may not include a frame, but may have the timing belt 26 connected directly to the antenna 12. A means for driving the timing belt is provided. The means for driving the timing belt 32 illustrated in FIG. 1 as a motor 34 connected to the timing belt 26 via a drive pulley 36. An idler pulley 38 may be used to ensure proper engagement between the timing belt 26 and the drive pulley 36. The timing belt 26 provides a means for exerting a pulling force on the first arm 20 and the second arm 22, thereby rotating the frame 18 and antenna 12 about the axis of elevational rotation 24. The timing belt 26 may be a nylon covered fiberglass reinforced neoprene product as is known in the art, and preferably will have teeth for non-slip connection with drive pulley 36 having matching notches. Other means for exerting a pulling force may include a chain, wire, or rope, with or without a non-slip feature.

The device of FIG. 1 may be configured to attach the timing belt 26 to the frame 18 at a variety of locations. Advantageously, by making these connections at a distance removed from the axis of elevational rotation 24, a mechanical advantage is provided that permits a reduction in the size of motor 34 required and/or a reduction in the gearing ratio required for the motor 34. A smaller motor results in a lower cost and lighter weight, and a reduction in the gearing ratio results in less slop in the drive train, thereby providing a more precise control of the antenna position.

When frame 18 is rotated about the axis of elevational rotation 24, the required length of the timing belt 26 may change. The amount and direction of change in length will depend on the angle between the first and the second arm 20,22, the location of the connections between the arms 20,22 and the timing belt 26, and the location, number and size of pulleys 36,38 in contact with the timing belt 26. It is possible to design a device with fixed pulley locations that will rotate without changing the length of the timing belt 26. Alternatively, the embodiment of FIG. 1 illustrates a design that utilizes a spring, preferably a constant force spring 40, to allow the location of one of the pulleys to change in response to rotation of the frame 18. Pulley assembly 42 pivots around an axis 44 and is held against the timing belt 26 by a constant force spring 40. Pulley assembly 42 provides a means for maintaining tension in the timing belt 26, and preferably a constant tension in the timing belt, during the rotation of the frame 18 and antenna 12. Any change in belt length required by the geometry of the device during the rotation of the frame 18 would normally result in an increase or a decrease in the tension in the timing belt 26. Such increase or decrease in tension instead results in compression or expansion of the spring 40 and movement of the pulley assembly 42 about axis 44, thereby effectively counteracting the required change in length of the timing belt 26 and resulting in a constant tension in the timing belt 26. Without such a means for maintaining tension, the timing belt 26 may loose tension and begin to slip on the drive pulley 36, resulting in failure of the device to operate properly.

Figure 2A:
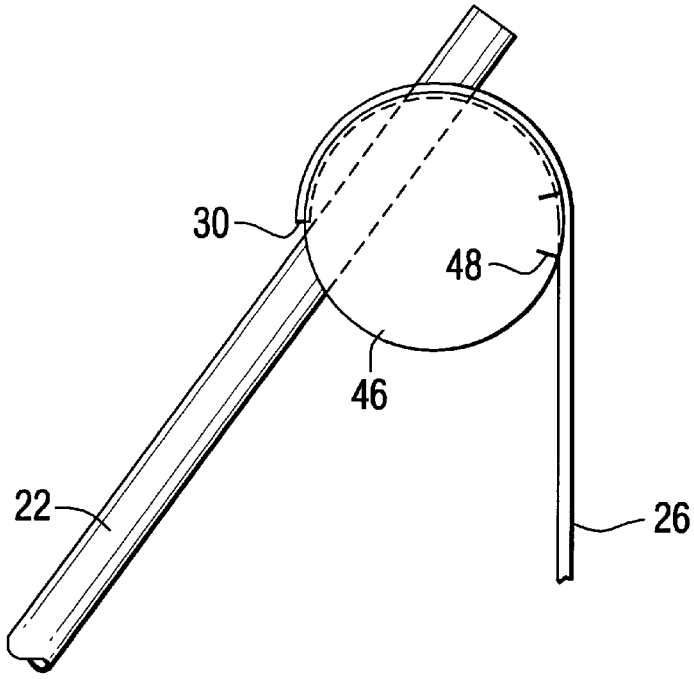
FIGS. 2A and 2B are side views of a cam for use with the device of FIG. 1.
Figure 2B:
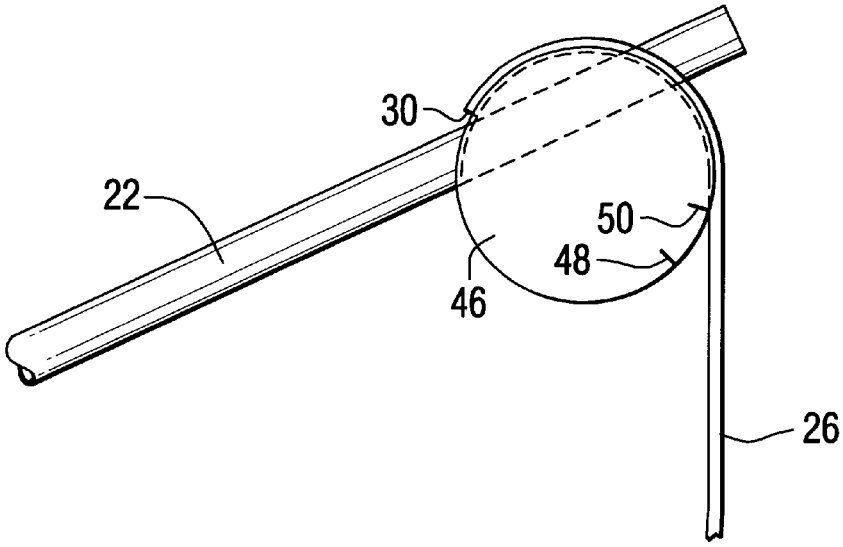

FIGS. 2A and 2B illustrate an alternative means for maintaining tension in the timing belt 26. FIG. 2A illustrates the second arm 22 and timing belt 26 of FIG. 1 in a first position. Attached to the second arm 22 is a cam 46. Timing belt 26 is wrapped around the cam 46 and may be fixedly attached to the cam 46 at its end 30. In the first position illustrated in FIG. 2A, the timing belt 26 is in contact with the cam 46 from its end 30 to a point 48 on the perimeter of the cam 46. When the frame 18 of FIG. 1 is rotated about its axis of elevational rotation 24, the second arm 22 will move to a second position illustrated in FIG. 2B. Note that in this second position the timing belt 26 is in contact with the perimeter of the cam 46 from its end 30 to a point 50. The change in length of contact between the timing belt 26 and the cam 46 from the positions of FIG. 2A to FIG. 2B may be selected to correspond and to compensate for the change in length of the timing belt 26 resulting from the rotation of the frame 18 around its axis of elevational rotation 24. The advantage of such a design over the design of FIG. 1 is that the constant force spring 40 may be eliminated. The shape of cam 46 may be round, elliptical, parabolic or other shape as required to maintain tension in the timing belt 26 as the antenna 12 is rotated. The cam 46 is illustrated as being attached to the second arm 22, although other embodiments may have such a cam 46 attached to the first arm 20 or the antenna 12.

The device 10 of FIG. 1 also includes a bracket 52 pivotally connected to the frame 18 about the axis for elevational rotation 24. Motor 34 may be mounted to the bracket 52. The bracket 52 may include a first beam 54 and a second beam 56 connected at their respective centers. First and second beams 54,56 may each be attached to rollers or wheels 58 for supporting the bracket 52 on a base plate 60.

Bracket 52 may be pivotally connected to the base plate 60 for rotation of the bracket 52 about an axis of azimuth rotation 62. A second timing belt 64 or other means for providing a pulling force is wrapped around at least a portion of a perimeter edge of the base plate 60 and is in contact with a pulley 66 connected to motor 68. Motor 68 is mounted on bracket 52 and is operable to rotate the bracket 52 about the axis of azimuth rotation 62 by driving the second timing belt 64 through pulley 66. Advantageously, by driving a timing belt 64 wrapped around a perimeter edge of a base plate 60, a mechanical advantage is provided that allows the size of motor 68 to be reduced when compared to prior art devices. A reduced motor size results in a decrease in cost and weight, and it eliminates the need for a high ratio gear train, thereby providing for more precise control of the azimuth location of the antenna. Note that the length of the second timing belt 64 does not change as the bracket 52 is rotated in relation to the base plate 60 since the geometry of the second timing belt 64 layout does not change during rotation. Therefore, no constant force spring or similar device is required for this drive mechanism.

The center connection between the base plate 60 and bracket 52 may include a rotary joint 70 at the axis of azimuth rotation 62. Rotary joints are known in the art for providing mechanical rotation while maintaining an electrical connection. Rotary joint 70 may preferably connect a single coaxial cable 72, and the electrical connection may include a means for multiplexing 74 electrical signals for both motors 34,68 and for antenna 12. Because the second timing belt 64 is continuous, and because the rotary joint 70 provides for unlimited rotation, the antenna 12 is provided with an unlimited range of movement in the azimuth direction.

Other aspects, objects and advantages of this invention may be obtained by studying the Figures, the disclosure, and the appended claims.

What is claimed is:

1. A device for positioning an antenna on a vehicle for receiving a direct broadcast satellite transmission, the device comprising:

a frame adapted for mounting an antenna thereon, the frame comprising a first arm and a second arm connected for elevational rotation relative to a bracket about an elevational pivot;

a first belt having a first end connected to the first arm and a second end connected to the second arm;

a means for driving the first belt to provide elevational rotation of the frame relative to the bracket about the elevational pivot;

a base plate pivotally connected to the bracket for azimuthal rotation of the bracket relative to the base plate about an azimuthal pivot;

a second belt disposed about a portion of a perimeter edge of the base plate;

a means for driving the second belt to provide azimuthal rotation of the base plate about the azimuthal pivot;

a rotary joint disposed at the azimuthal pivot for providing an electrical connection during mechanical rotation of the bracket relative to the base plate which maintains an uninterrupted coaxial cable connection during continuous azimuthal rotation of the bracket; and a multiplexing device for conducting a plurality of electrical signals through the rotary joint.

2. The device of claim 1, further comprising a cam connected to one of the first and the second arms and in contact with the first belt, wherein the portion of the first belt in contact with the cam varies as the frame is rotated about the elevational pivot.

3. The device of claim 1, wherein the means for driving the first belt comprises a motor attached to the bracket and driving the first belt via a drive pulley.

4. The device of claim 3, wherein the means for driving the second belt comprises a motor attached to the bracket and driving the second belt via a drive pulley.

5. A device for receiving a direct broadcast signal, the device comprising:

an antenna having a coaxial cable output;

a bracket pivotally connected to the antenna by an elevational pivot;

a first belt having a first end and a second end attached to the antenna on opposed sides of the elevational pivot;

a first motor having an output drive in contact with the first belt and operable to drive the first belt to provide elevational rotation of the antenna;

a base plate pivotally connected to the bracket by an azimuthal pivot;

a second belt disposed about a portion of a perimeter edge of the base plate;

a second motor having an output drive in contact with the second belt and operable to drive the second belt to provide azimuthal rotation of the antenna;

a rotary joint having an input end connected to the coaxial cable and disposed at the azimuthal pivot for providing an electrical connection during mechanical rotation of the bracket relative to the base plate which maintains a non-rotating coaxial cable output connection during azimuthal rotation of the bracket; and a multiplexing device for conducting a plurality of electrical signals through the rotary joint.

6. The device of claim 5, further comprising a cam connected to one of the first and the second arms and in contact with the first belt, wherein the portion of the first belt in contact with the cam varies as the frame is rotated about the elevational pivot.

* * * * *